US009500397B2

(12) United States Patent
Jeong et al.

(10) Patent No.: US 9,500,397 B2
(45) Date of Patent: Nov. 22, 2016

(54) REFRIGERANT SYSTEM AND A CONTROL METHOD THE SAME

(75) Inventors: Hojong Jeong, Seoul (KR); Baikyoung Chung, Seoul (KR); Jaehwa Jung, Seoul (KR); Yongcheol Sa, Seoul (KR); Byungsoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 603 days.

(21) Appl. No.: 13/876,102

(22) PCT Filed: Sep. 22, 2011

(86) PCT No.: PCT/KR2011/006996

§ 371 (c)(1),
(2), (4) Date: Jun. 4, 2013

(87) PCT Pub. No.: WO2012/044008

PCT Pub. Date: Apr. 5, 2012

(65) Prior Publication Data

US 2013/0298582 A1 Nov. 14, 2013

(30) Foreign Application Priority Data

Sep. 27, 2010 (KR) ..... 10-2010-0093469

(51) Int. Cl.

| | |
|---|---|
| ***F25B 45/00*** | (2006.01) |
| ***F24B 7/00*** | (2006.01) |
| ***F25B 41/00*** | (2006.01) |
| ***F25B 49/00*** | (2006.01) |
| ***G01K 13/00*** | (2006.01) |
| ***F25B 49/02*** | (2006.01) |
| *F25B 13/00* | (2006.01) |

(52) U.S. Cl.

CPC ..... *F25B 49/02* (2013.01); *F25B 45/00* (2013.01); *F25B 13/00* (2013.01); *F25B 2313/0253* (2013.01); *F25B 2313/0315* (2013.01); *F25B 2345/003* (2013.01); *F25B 2700/1931* (2013.01)

(58) Field of Classification Search

CPC F25B 45/00; F25B 13/00; F25B 2313/0253; F25B 2313/0315; F25B 2345/003; F25B 2700/1931; F25B 49/02

See application file for complete search history.

(56) References Cited

U.S. PATENT DOCUMENTS 4,437,317 A * 3/1984 Ibrahim ..... F25B 47/022 62/152
4,693,089 A * 9/1987 Bourne ..... F24D 3/08 62/238.6
4,765,149 A * 8/1988 Shiga ..... F25B 45/00 62/174

(Continued)

FOREIGN PATENT DOCUMENTS

JP 08-145481 6/1996
JP H08-145482 * 6/1996

(Continued)

*Primary Examiner* — Henry Crenshaw
(74) *Attorney, Agent, or Firm* — Dentons US LLP

(57) ABSTRACT

A refrigerant system according to an embodiment of the disclosure includes a outdoor heat exchanger performing heat exchange between outdoor air and a refrigerant; a compressor compressing the refrigerant; an indoor heat exchanger performing heat exchange between indoor air and the refrigerant; an expansion portion expanding the refrigerant; and a refrigerant pipe connecting the outdoor heat exchanger, the compressor, the indoor heat exchanger and the expansion portion to form a refrigerant cycle, wherein the outdoor heat exchanger includes a refrigerant storage portion storing the refrigerant to control flowing refrigerant amount on the refrigerant cycle.

6 Claims, 2 Drawing Sheets

(56) References Cited

U.S. PATENT DOCUMENTS 5,323,617 A * 6/1994 Ichikawa ..... F25B 13/00 62/129
5,533,351 A * 7/1996 Miyata ..... F25B 13/00 62/174
5,737,931 A * 4/1998 Ueno ..... F25B 9/006 62/126
5,802,860 A * 9/1998 Barrows ..... F25B 41/04 62/126
6,062,035 A * 5/2000 Ueno ..... F24F 5/0017 62/324.1
2005/0097904 A1* 5/2005 Lifson ..... F25B 45/00 62/149
2009/0013700 A1* 1/2009 Unezaki ..... F25B 9/008 62/77

FOREIGN PATENT DOCUMENTS

| | | |
|---|---|---|
| JP | 10-160268 | 6/1998 |
| JP | 10-238895 | 9/1998 |
| JP | 2006-029614 | 2/2006 |
| JP | 2007-303807 | 11/2007 |

* cited by examiner

REFRIGERANT SYSTEM AND A CONTROL METHOD THE SAME

This application is a 35 U.S.C. §371 National Stage entry of International Application No. PCT/KR2011/006996, filed on Sep. 22, 2011, and claims priority to Korean Application No. 10-2010-0093469, filed Sep. 27, 2010, each of which are hereby incorporated by reference in their entirety as if fully set forth herein.

TECHNICAL FIELD

The present disclosure relates to a refrigerant system performing a refrigerant cycle.

BACKGROUND ART

In general, a refrigerant system performs a refrigerant cycle including compressing-condensing-expanding-evaporating to heat and cool interior.

The refrigerant system includes an indoor unit performing heat exchange between refrigerant and indoor air, and an outdoor unit performing heat exchange between refrigerant and outdoor air. The indoor unit includes an indoor heat exchanger performing heat exchange between the refrigerant and the indoor air, a fan ventilating the indoor air, and a motor rotating the fan. The outdoor unit includes an outdoor heat exchanger performing heat exchange between the refrigerant and the outdoor air, a fan ventilating the outdoor air, a motor rotating the fan, a compressor compressing the refrigerant, an expansion portion expanding the refrigerant, and a 4-way valve changing flowing direction of the refrigerant.

Further, when performing indoor cooling, the indoor heat exchanger becomes a evaporator and the outdoor heat exchanger becomes a condenser. When performing indoor heating, the indoor heat exchanger becomes a condenser and the outdoor heat exchanger becomes an evaporator. Switching of the cooling and heating is performed by changing flowing direction of the refrigerant by the 4-way valve.

DISCLOSURE OF INVENTION

Technical Problem

The disclosure provides the refrigerant system flowing optimal refrigerant amount according to operating condition and an object thereof is to provide the refrigerant system with improved operating efficiency.

Solution to Problem

A refrigerant system according to an embodiment of the disclosure includes a outdoor heat exchanger performing heat exchange between outdoor air and refrigerant; a compressor compressing the refrigerant; an indoor heat exchanger performing heat exchange between indoor air and the refrigerant; an expansion portion expanding the refrigerant; and a refrigerant pipe connecting the outdoor heat exchanger, the compressor, the indoor heat exchanger and the expansion portion to form a refrigerant cycle, wherein the outdoor heat exchanger includes a refrigerant storage portion storing the refrigerant to control flowing refrigerant amount on the refrigerant cycle.

A control method for the refrigerant system according to another embodiment, including a compressor, an outdoor heat exchanger, an indoor heat exchanger and an evaporator, includes sensing outlet pressure of the compressor; sensing overcooling degree after the refrigerant discharged at the outdoor heat exchanger or the indoor heat exchanger is overcooled, and selectively limiting discharging at least portion of the refrigerant introduced into the outdoor heat exchanger from the outdoor heat exchanger based on one value of the outlet pressure of the compressor and the overcooling degree.

Advantageous Effects of Invention

In the refrigerant system, the portion of the refrigerant on the refrigerant cycle may be selectively stored in the refrigerant storage portion of the outdoor heat exchanger according to indoor air-conditioning load amount. Particularly, when the indoor air-conditioning load amount is reduced, the portion of the refrigerant on the refrigerant cycle is stored in the refrigerant storage portion by closing the storage opening/closing portion, thereby reducing condensing heat and evaporating heat.

Further, when the indoor air-conditioning load amount is increased, the refrigerant of the refrigerant storage portion is supplemented into the main refrigerant pipe by opening the storage opening/closing portion and flowing refrigerant amount on the refrigerant cycle is increased, thereby increasing condensing heat and evaporating heat. That is, there is an advantage that optimal refrigerant amount may flows according to operation condition.

Further, performance of the refrigerant system to deal indoor air-conditioning load amount may be varied by only changing flowing refrigerant amount on the refrigerant cycle without changing operating rate of the compressor, thereby improving the whole operating efficiency of the refrigerant system.

MODE FOR THE INVENTION

Hereinafter, an exemplary embodiment of the disclosure will be described in detail with reference to drawings. However, the disclosure cannot be limited to the embodiment in which the idea of the disclosure is presented, another embodiment included within range of idea of another backward disclosure or the closure may be easily proposed by addition, change, deletion and the like of another constituent.

Figure 1:
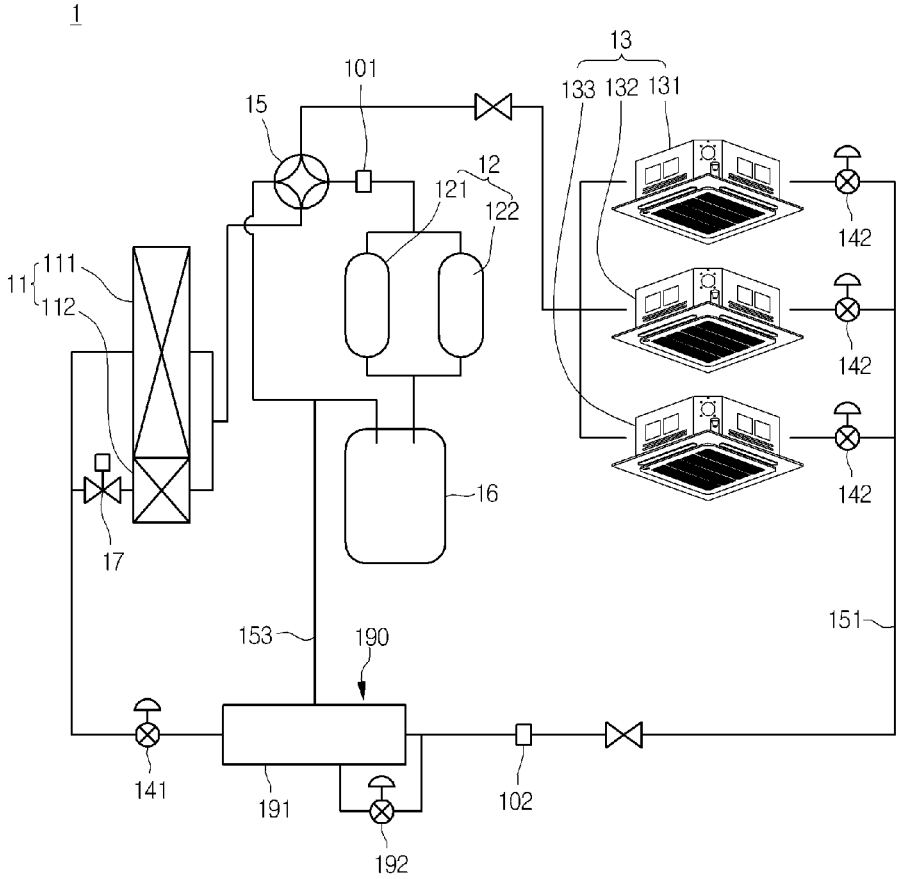
FIG. 1 is a system configuration view of a refrigerant system according to an exemplary embodiment of the disclosure.

FIG. 1 is a system configuration view of a refrigerant system according to an exemplary embodiment of the disclosure.

In FIG. 1, a refrigerant system 1 further includes a outdoor heat exchanger 11 performing heat exchange between the outdoor air and the refrigerant, a compressor 12 compressing the refrigerant, an indoor heat exchanger 13 performing heat exchange between indoor air and the refrigerator, an expansion portion 141, 142 expanding the refrigerant, a main refrigerant pipe 151 connecting the outdoor heat exchanger 11, the compressor 12, the indoor heat exchanger 13 and the expansion portion 141, 142 to form a refrigerant cycle, a accumulator 16 filtering liquefied refrigerant of the refrigerant flowing toward the compressor 12, a flowing switching portion 15 selectively switching flowing direction of the refrigerant discharged from the compressor 12 toward any one of the outdoor heat exchanger 11 and the indoor heat exchanger 13.

The outdoor heat exchanger 11 and the indoor heat exchanger 13 act as a condenser or an evaporator according to operating mode of the refrigerant system. For example, when heating-operating the refrigerant system, the outdoor heat exchanger 11 and the indoor heat exchanger 13 act as the condenser and the evaporator, respectively. when cooling-operating the refrigerant system, the outdoor heat exchanger 11 and the indoor heat exchanger 13 act as the evaporator and the condenser, respectively. At this time, the flowing direction of the refrigerant is switched by the flowing switching portion 15 according to operating mode of the refrigerant system to change the flowing direction of the refrigerant on the refrigerant cycle.

On the other hand, the refrigerant system includes the compressor 12, the condenser condensing the refrigerant passing through the compressor 12, the expansion portion 141, 142 expanding the refrigerant passing through the condenser, an evaporator evaporating the refrigerant passing through the expansion portion 141, 142, the main refrigerant pipe 151 connecting the compressor 12, the condenser, the expansion portion 141, 142 and the evaporator to form the refrigerant cycle, and the accumulator 16.

The outdoor heat exchanger 11 is disposed at one side of the outside to expose to outdoor air. Further, the indoor heat exchanger 13 is disposed at indoor space to air-condition interior. At this time, the indoor heat exchanger 13 may include a plurality of indoor heat exchange portion 131, 132, 133 disposed at a plurality of indoor space, respectively.

The compressor 12 may include a fixed quantity compressor 121 maintaining a constant compression quantity, and an inverter compressor 122 varying compression quantity.

Further, the expansion portion 141, 142 may include outdoor expansion portion 141 disposed at one side of the main refrigerant pipe 151 adjacent to the outdoor heat exchanger 11, and indoor expansion portion 142 disposed at one side of the main refrigerant pipe 151 adjacent to the indoor heat exchanger 13.

The indoor expansion portion 142 may includes a plurality of indoor expansion portions 142 disposed to be corresponded at one side of the plurality of the indoor heat exchange portion 131, 132, 133, respectively. In such a case, The indoor expansion portion 142 may selectively block the refrigerant introduced into the plurality of the indoor heat exchange portion 131, 132, 133, respectively, according to whether or not the plurality of the indoor heat exchange portion 131, 132, 133 are operated.

Further, the outdoor expansion portion 141 and the indoor expansion portions 142 includes for example, a valve controlling opening degree, such as an electronic expansion valve EEV and may control the opening degree according to operating mode of the refrigerant system.

In more detail, when heating-operating the refrigerant system, the indoor expansion portions 142 is opened perfectly. The refrigerant passing through the indoor heat exchanger 13 passes the indoor expansion portions 142 without changing the condition by partly opening the outdoor expansion portion 141 and may be introduced into the outdoor heat exchanger 11 after expanding while passing the outdoor expansion portion 141.

On the other hand, when cooling-operating the refrigerant system, the outdoor expansion portions 141 is opened perfectly. The refrigerant passing through the outdoor heat exchanger 11 passes the outdoor expansion portions 141 without changing the condition by partly opening the indoor expansion portion 142 and may be introduced into the indoor heat exchanger 13 after expanding while passing the indoor expansion portion 142.

On the other hand, the refrigerant system further includes a refrigerant storage portion 112 storing a portion of the refrigerant of the refrigerant cycle to control flowing refrigerant amount on the refrigerant cycle.

In more detail, the outdoor heat exchanger 11 includes a plurality of outdoor heat exchange portion 111, 112 in which the refrigerant of the main refrigerant pipe 151 is branched and flows independently, respectively. The plurality of outdoor heat exchange portion 111, 112 are connected in parallel to each other on the main refrigerant pipe 151, and the refrigerant introduced into the outdoor heat exchanger 11 flows into the refrigerant storage portion 112 and the outdoor heat exchange portion 111 except the refrigerant storage portion 112.

The plurality of outdoor heat exchange portions 111, 112 are disposed adjacently to each other to expose to the outdoor air simultaneously. At least one of the plurality of outdoor heat exchange portions 111, 112 is the refrigerant storage portion 112.

Further, one side of the main refrigerant pipe 151 adjacent to the refrigerant storage portion 112 is provided with a storage opening/closing portion 17 selectively blocking the refrigerant flowing of the refrigerant storage portion 112.

When opening the storage opening/closing portion 17, the refrigerant continuously flows into the outdoor heat exchange portion 111 and the refrigerant storage portion 112.

On the other hand, when closing the storage opening/closing portion 17, the refrigerant introduced into the refrigerant storage portion 112 of the refrigerant on the refrigerant cycle stays in the condition to be stored to the refrigerant storage portion 112. That is, at least portion of the refrigerant introduced into the outdoor heat exchanger 11 is stored in the refrigerant storage portion 112 to limit discharging from the outdoor heat exchanger 11.

On the other hand, the refrigerant storage portion 112 may be positioned at the bottom of the heat exchange portions 111. That is, the refrigerant storage portion 112 of the plurality of the outdoor heat exchange portions 111, 112 may be positioned at the bottom of the heat exchange portions 111

In detail, when the outdoor heat exchanger 11 includes the heat exchange portions 111, 112 divided vertically, since lower refrigerant storage portion 112 has a lower wind speed regarding the air to be heat-exchanged as compared with upper heat exchange portions 111 to form low heat exchange amount, the refrigerant storage portion 112 may be selected as lower outdoor heat exchange portion 112 of a plurality of the outdoor heat exchange portions 111, 112. In this case, although limiting the refrigerant flowing into the refrigerant storage portion 112, a phenomenon, in which heat exchange efficiency is abruptly lowered, may be prevented.

The refrigerant system further includes a over-cooler 190 overcooling the refrigerant passing through the condenser. The over-cooler further includes a bypass pipe 153 bypassing the portion of the refrigerant passing through the condenser and guiding to inflow side of the accumulator 16, a overcooling heat exchanger 191 performing heat-exchange between the portion of the refrigerant to be bypassed and the refrigerant of the main refrigerant pipe 151, and a overcooling control portion 192 controlling the portion of the refrigerant passing through the overcooling heat exchanger 191.

Hereinafter, control flowing for the refrigerant system of an embodiment of the disclosure will be described in detail with reference to drawings.

Figure 2:
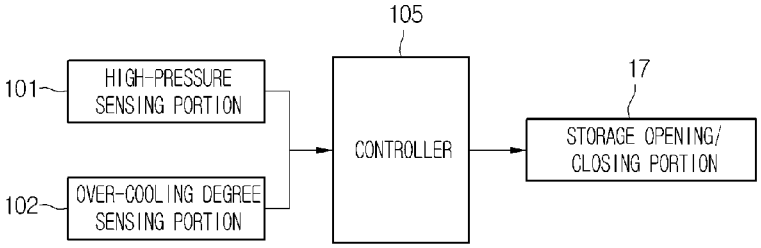
FIG. 2 is control configuration view showing control signal flowing of a refrigerant system according to an exemplary embodiment of the disclosure.
Figure 3:
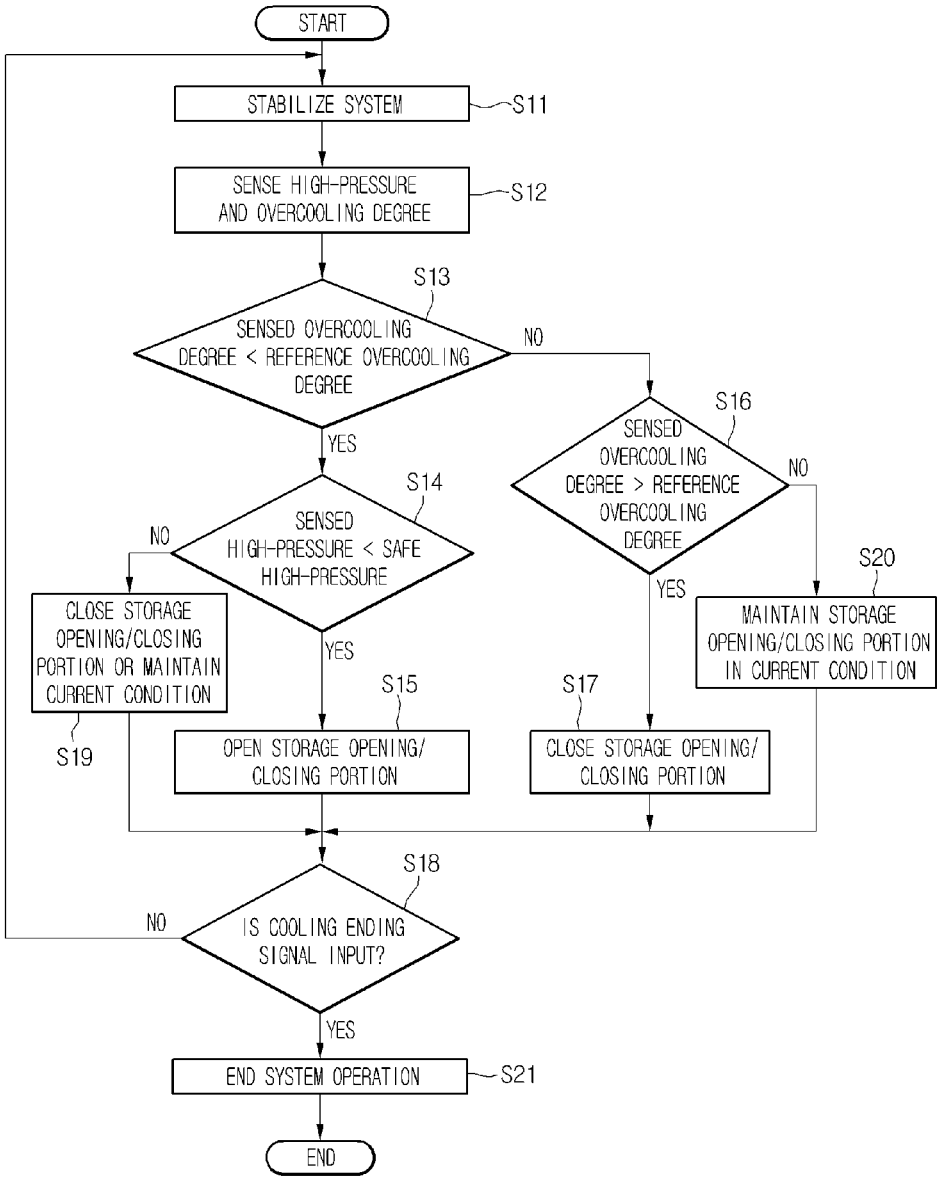
FIG. 3 is flow chart showing control flowing of a refrigerant system according to an exemplary embodiment of the disclosure.

FIG. 2 is control configuration view showing control signal flowing of the refrigerant system according to an exemplary embodiment of the disclosure and FIG. 3 is flow chart showing control flowing of the refrigerant system according to an exemplary embodiment of the disclosure.

First in FIG. 2, the refrigerant system 1 includes a high-pressure sensing portion 101 sensing pressure of the refrigerant discharged from the compressor 12, i.e., high-pressure, a overcooling degree sensing portion 102 sensing temperature of the refrigerant passing through the condenser, i.e., overcooling degree, and a controller 105 controlling the storage opening/closing portion 17 based on information sensed from the storage opening/closing portion 17, the high-pressure sensing portion 101 and the overcooling degree sensing portion 102.

The high-pressure sensing portion 101 is disposed at one side of the main refrigerant pipe 151 corresponding to discharge side of the compressor 12 so as to easily sense the refrigerant pressure of discharge side of the compressor 12 and the overcooling degree sensing portion 102 is disposed at one side of the main refrigerant pipe 151 corresponding to discharge side of the condenser so as to easily sense temperature of the refrigerant passing through the condenser.

On the other hand, when disposing over-cooler, the overcooling degree sensing portion 102 may be disposed at one side of the main refrigerant pipe 151 corresponding to discharge side of the over-cooler. In addition, the high-pressure sensing portion 101, the overcooling degree sensing portion 102, the storage opening/closing portion 17 and the controller 105 are electrically connected to each other to transmit and receive control signal.

In FIG. 3, the control flowing of the refrigerant system will be described. As a example, the case, in which the refrigerant system is cooling-operated, is described.

First, if cooling-operation of the refrigerant system is started, the process stabilizing the refrigerant system in totality is performed (S11). For example, if cooling-operation of the refrigerant system is started, since flowing condition of the refrigerant is changed, it takes time to stabilize operating condition of the refrigerant system. At this time, time required for stabilization for operation condition of the refrigerant system is necessary to the process stabilizing the refrigerant system.

If the refrigerant system is stabilized, the high-pressure and overcooling degree are sensed (S12). At this time, the high-pressure and overcooling degree may be sensed by the high-pressure sensing portion 101 and the overcooling degree sensing portion 102.

When the overcooling degree sensed by the overcooling degree sensing portion 102, i.e., sensed overcooling degree is below reference overcooling degree (S13) and the high-pressure sensed by the high-pressure sensing portion 101, i.e., sensed high-pressure is below safe high-pressure (S14), the storage opening/closing portion 17 is controlled to be opened (S15).

The reference overcooling degree may mean an appropriate overcooling degree value to deal indoor air-condition load, i.e., to cool interior. The reference overcooling degree may become specific overcooling degree value and may become range of appropriate overcooling degree value to deal indoor air-condition load. Thus, when the sensed overcooling degree is below the reference overcooling degree, It means lack of overcooling degree on the refrigerant cycle to deal the indoor air-conditioning load.

When the sensed overcooling degree exceeds the reference overcooling degree, It means excessive of overcooling degree on the refrigerant cycle to deal the indoor air-conditioning load. The high-pressure and overcooling degree, properties changing according to indoor air-condition load of the refrigerant system, is compared with the reference high-pressure and the reference overcooling degree, and in line with thinking, the indoor air-condition load of the refrigerant system is compared with the standard load.

The safe high-pressure means minimum high-pressure value that is likely to be hard on the compressor 12 and the refrigerant pipe. That is, when the high-pressure on the refrigerant cycle is above the safe high-pressure, it may be worried that it can damage the compressor 12 and the refrigerant pipe.

Thus, when the sensed high-pressure is above the safe high-pressure (S14), the process proceeds to next step without opening the storage opening/closing portion 17, i.e. in the condition closing opening degree of the storage opening/closing portion 17 or maintaining to current opening degree. In this case, the damage of the compressor 12 and the refrigerant pipe is prevented.

Further, whether opening degree of the storage opening/closing portion 17 is closed or whether the current opening degree is maintained may be determined according to how much the sensed high-pressure is higher than the safe high-pressure. As a example, the sensed high-pressure is above the set pressure as compared with the safe high-pressure, opening degree of the storage opening/closing portion 17 is closed and the sensed high-pressure is below the set pressure as compared with the safe high-pressure, opening degree of the storage opening/closing portion 17 is maintained (S19).

On the other hand, when the sensed overcooling degree exceeds the reference overcooling degree (S16), the storage opening/closing portion 17 is controlled to be closed (S17). That is, when closing the storage opening/closing portion 17, the portion of the refrigerant on the refrigerant cycle is maintained in the condition stored to the refrigerant storage portion 112.

In above description, controlling the storage opening/closing portion 17 to be opened means perfectly opening the storage opening/closing portion 17 or opening by opening degree wider than opening degree of the storage opening/closing portion 17 of the current condition. On the other hand, controlling the storage opening/closing portion 17 to be closed means perfectly closing the storage opening/closing portion 17 or opening by opening degree narrower than opening degree of the storage opening/closing portion 17 of the current condition.

On the other hand, when the sensed overcooling degree does not exceeds the reference overcooling degree (S13) and does not exceed the reference overcooling degree (S16), i.e., the sensed overcooling degree is the reference overcooling degree, the current condition (degree) of the storage opening/closing portion 17 is maintained (S20).

Further, when signal input ending cooling operation of the refrigerant system is not present (S18), stabilization process of the refrigerant system is performed (S11). At this time, signal input ending heating operation of the refrigerant system includes internally set ending conditions as well as separate signal input by user. If the cooling ending signal is input, operating of the refrigerant system is ended (S21).

In the refrigerant system, there is an advantage that the flowing refrigerant amount on the refrigerant cycle may be optimally controlled according to operation condition of the refrigerant system.

In more detail, when the sensed overcooling degree is below the reference overcooling degree during cooling operating, the refrigerant flows through the refrigerant storage portion 112 by opening the storage opening/closing portion 17, such that the flowing refrigerant amount on the refrigerant cycle is increased. The flowing refrigerant amount on the refrigerant cycle is increased to increase the overcooling degree, thereby controlling to be reached to the reference overcooling degree.

On the other hand, when the sensed overcooling degree exceeds the reference overcooling degree, the portion of the refrigerant on the refrigerant cycle is stored in the refrigerant storage portion 112 by closing the storage opening/closing portion 17. That is, the flowing refrigerant amount on the refrigerant cycle is decreased to decrease the overcooling degree, thereby controlling to be reached to the reference overcooling degree.

Further, in the refrigerant system, there is an advantage that the whole operating efficiency of the refrigerant system is improved. In more detail, for example, the flowing refrigerant amount on the refrigerant cycle only is changed to change performance of the refrigerant to deal the indoor air-conditioning load amount without changing operating rate of the compressor 12 and rotation speed of fan (not shown) and the like. Thus, the whole operating efficiency of the refrigerant system is improved.

Further, in the refrigerant system, there is an advantage that the operating efficiency may be optimized within the range capable of preventing damage of the refrigerant system.

In more detail, although the sensed overcooling degree is below the reference overcooling degree during the cooling operating, the sensed high-pressure is above the safe high-pressure, the process proceeds to next step without manipulating the storage opening/closing portion 17.

That is, although the flowing refrigerant amount is increased to improve the overcooling degree by opening the storage opening/closing portion 17, the high-pressure is increased together. Then, when the sensed high-pressure is above the safe high-pressure, the damage of the compressor 12 and the refrigerant pipe may be prevented by controlling to make the storage opening/closing portion 17 be not opened.

Another embodiment of the disclosure is proposed.

Although FIG. 3 describes the case in which the refrigerant system performs cooling operation, on the other hand, when the refrigerant system performs heating operation, the opening degree of the storage opening/closing portion 17 is maintained in the opened condition.

When the refrigerant system performs the heating operation, since the refrigerant amount to be required is larger than the refrigerant amount required during the heating operation, the opening degree of the storage opening/closing portion 17 is maintained in the opened condition to secure the refrigerant amount circulating the refrigerant system.

Another embodiment of the disclosure is proposed.

When the operation of at least one of indoor heat exchange portion of the plurality of indoor heat exchange portion 131, 132, 133 is stopped, i.e., when indoor load conditions is changed (part load operating), the refrigerant larger than actually needed indoor load conditions may be introduced into the outdoor heat exchanger 11.

In this case, at least portion of the refrigerant circulating the refrigerant system is stored in the refrigerant storage portion 112 by controlling opening degree of the storage opening/closing portion 17 to maintain the refrigerant amount of system optimally.

INDUSTRIAL APPLICABILITY

In a dishwasher according to an embodiment of the disclosure, optimal refrigerant amounts flow according to operating condition, and the flowing refrigerant amount on the refrigerant cycle only is changed to change performance of the refrigerant system to deal indoor air-conditioning load amount without changing operation rate of the compressor, thereby enhancing industrial applicability.

The invention claimed is:

1. A refrigerant system, comprising:

a compressor compressing refrigerant;

an outdoor heat exchanger installed at an outlet of the compressor, the outdoor heat exchanger including:

a heat exchange portion configured to perform heat exchange between outdoor air and the refrigerant; and a refrigerant storage portion connected in parallel to the heat exchange portion to store the refrigerant;

an indoor heat exchanger installed at an inlet of the compressor and configured to perform heat exchange between indoor air and the refrigerant;

a refrigerant pipe connecting the outdoor heat exchanger, the compressor, and the indoor heat exchanger to form a refrigerant cycle;

an expansion device installed at a portion of the refrigerant pipe to expand the refrigerant, the portion of the refrigerant pipe being configured to connect the outdoor heat exchanger with the indoor heat exchanger, wherein the refrigerant pipe includes: a first branch pipe connected with an inlet of the heat exchange portion; a second branch pipe connected with an inlet of the refrigerant storage portion; a first branch spot that connects the first branch pipe and the second branch pipe and allows the refrigerant discharged from the compressor to flow into the first branch pipe and the second branch pipe; a third branch pipe connected with an outlet of the heat exchange portion; a fourth branch pipe connected with an outlet of the refrigerant storage portion; and a second branch spot that connects the third branch pipe and the fourth branch pipe and allows the refrigerant passing through the heat exchange portion and the refrigerant storage portion to flow into the expansion portion, and wherein the refrigerant system further comprises:

a high-pressure sensor sensing refrigerant high pressure for discharge side of the compressor, and a sub-cooling degree sensor sensing a degree of discharge side refrigerant of the outdoor heat exchanger during cooling operation;

a valve installed at the fourth branch pipe, to adjust the amount of the refrigerant flowing into the refrigerant storage portion; and a controller configured to close the valve when the sub-cooled degree sensed by the sub-cooled degree sensor is greater than a reference sub-cooled degree, wherein the controller controls operation of the valve, based on a value of the high-pressure sensed by the high-pressure sensor when the sub-cooled degree sensed is less than the reference sub-cooled degree, the controller being configured to:

open the valve when the value of high-pressure is less than a safe high-pressure, and close the valve when the value of high-pressure is greater than the safe high-pressure.

2. The refrigerant system according to claim 1, wherein the outdoor heat exchanger includes a plurality of outdoor heat exchange portions, and the refrigerant storage portion is at least one of the plurality of heat exchange portions.

3. The refrigerant system according to claim 1, wherein when operating cooling, the controller controls the valve so that the refrigerant is selectively stored in the refrigerant storage portion, and when operating heating, the controller controls so that the valve maintains an opened condition.

4. The refrigerant system according to claim 1, wherein the controller controls the valve based on a indoor air condition load so that the refrigerant is selectively stored in the refrigerant storage portion.

5. The refrigerant system according to claim 4, wherein the indoor heat exchanger includes a plurality of indoor heat exchange portions, and when at least one of the indoor heat exchange portions of the plurality of indoor heat exchange portions is stopped, the opening degree of the valve is controlled such that the refrigerant is stored in the refrigerant storage portion.

6. The refrigerant system according to claim 1, wherein when the sensed sub-cooled degree is approximately same as the reference overcooling degree, the opening degree of the valve is maintained in current opening degree.

* * * * *